United States Patent [19]

Reece

[11] 4,235,140

[45] Nov. 25, 1980

[54] PORTABLE CHAIN SAW MILL

[76] Inventor: Daniel R. Reece, 2081 SW. Bonniebrae Dr., Lake Oswego, Oreg. 97034

[21] Appl. No.: 57,206

[22] Filed: Jul. 13, 1979

[51] Int. Cl.[3] ..... B27B 17/00

[52] U.S. Cl. ..... 83/794; 83/574; 83/821; 83/859

[58] Field of Search ..... 83/788, 794, 800, 574, 83/859, 821, 829

[56] References Cited

U.S. PATENT DOCUMENTS 3,695,316 10/1972 Pluckhahn ..... 83/794

FOREIGN PATENT DOCUMENTS 1037835 9/1978 Canada ..... 83/574

*Primary Examiner*—J. M. Meister

*Attorney, Agent, or Firm*—Kolisch, Hartwell & Dickinson

[57] ABSTRACT

The specification discloses a mill including a track having separable sections clamped to ground bearing cross members to which a log to be ripped is dogged. A carriage has deeply flanged rollers engaging opposite track members and supporting a post. A crossarm support is adjustable up and down the post and a horizontal crossarm is adjustable horizontally on the support by a rack and pinion drive. A saw bar of a chain saw is bolted to a quadrant which is quickly adjustable between a vertical position and a horizontal position of the saw bar. A handle on the carriage is adapted to be pushed by an operator to move the carriage along the track, and a bowden-wire control to the throttle of the chain saw is mounted on the handle.

14 Claims, 10 Drawing Figures

12
186
182
29
180
28
26
184
30
178
176
168
18
8
8
24
52
54
36
32
25
40
34
38
20
29
2
180
162
2
110
128
120
154
170
152
22
196
3
84
114
6
122
14
158
66
64
194
62
82
68
86
89
114
162
30
70
192
190
6
60
112
134
196
198
29
30

72
64
68
76
78
80
74
62
82
79
9
56
40
52
50
44
42
46
54
25
36
32
35
34
20
24
18
8
48
38

PORTABLE CHAIN SAW MILL

DESCRIPTION

This invention relates to, and has for an object thereof the provision of, a portable chain saw mill.

Another object of the invention is to provide a chain saw mill which is easily set up and taken down.

A further object of the invention is to provide a chain saw mill in which a chain saw is mounted on one side of a carriage having a handle at its opposite side for pushing the carriage along a track paralleling a log to be sawed.

Another object of the invention is to provide a portable chain saw mill in which a carriage has a pair of grooved rollers movable along a lower track member and a third grooved roller movable along an upper track member.

Another object of the invention is to provide a portable chain saw mill which has a chain saw supporting crossarm carried by a guide and movable along the guide by a rack and pinion drive.

Another object of the invention is to provide a portable chain saw mill in which a crossarm is adjustable horizontally and vertically on a carriage carrying a chain saw adjustably between vertical and horizontal positions.

Figure 1:
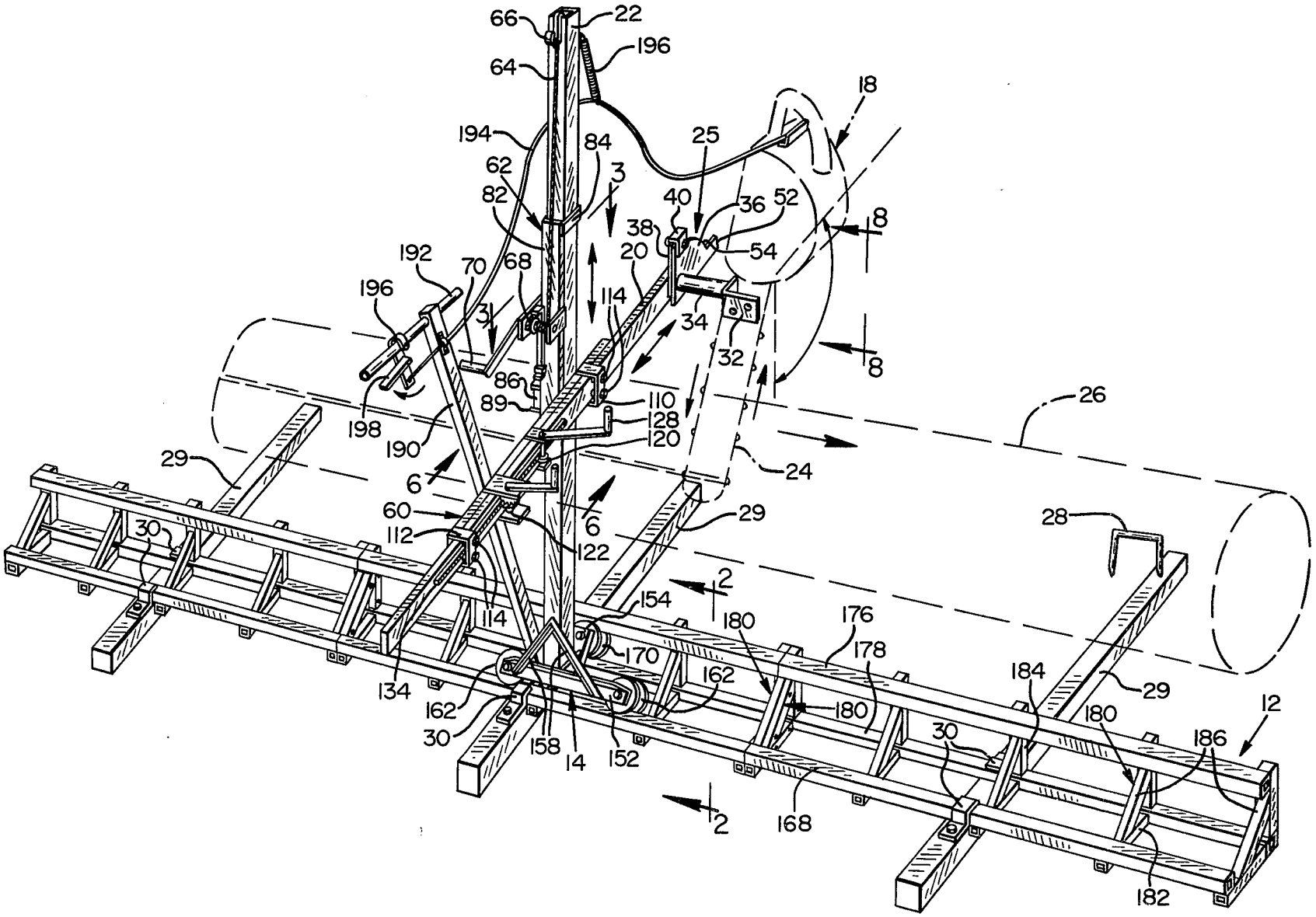
FIG. 1 is a perspective view of a portable chain saw mill forming one embodiment of the invention.

A portable chain saw mill forming one specific embodiment of the invention and shown in the drawings includes a sectional track 12 along which a carriage 14 may be pushed by a handle 16 to move a chain saw 18 carried by a crossarm 20 adjustable horizontally and vertically on a post 22 on the carriage. A saw bar 24 of the chain saw is adjustable by a quadrant 25 from a vertical position to a horizontal position for making either a vertical cut or a horizontal cut in a log 26 held by dogs 28 on cross members 29 to which the track 12 is clamped by pairs of releasable clamps 30 bolted to the cross members.

Figures 8, 9, 10:
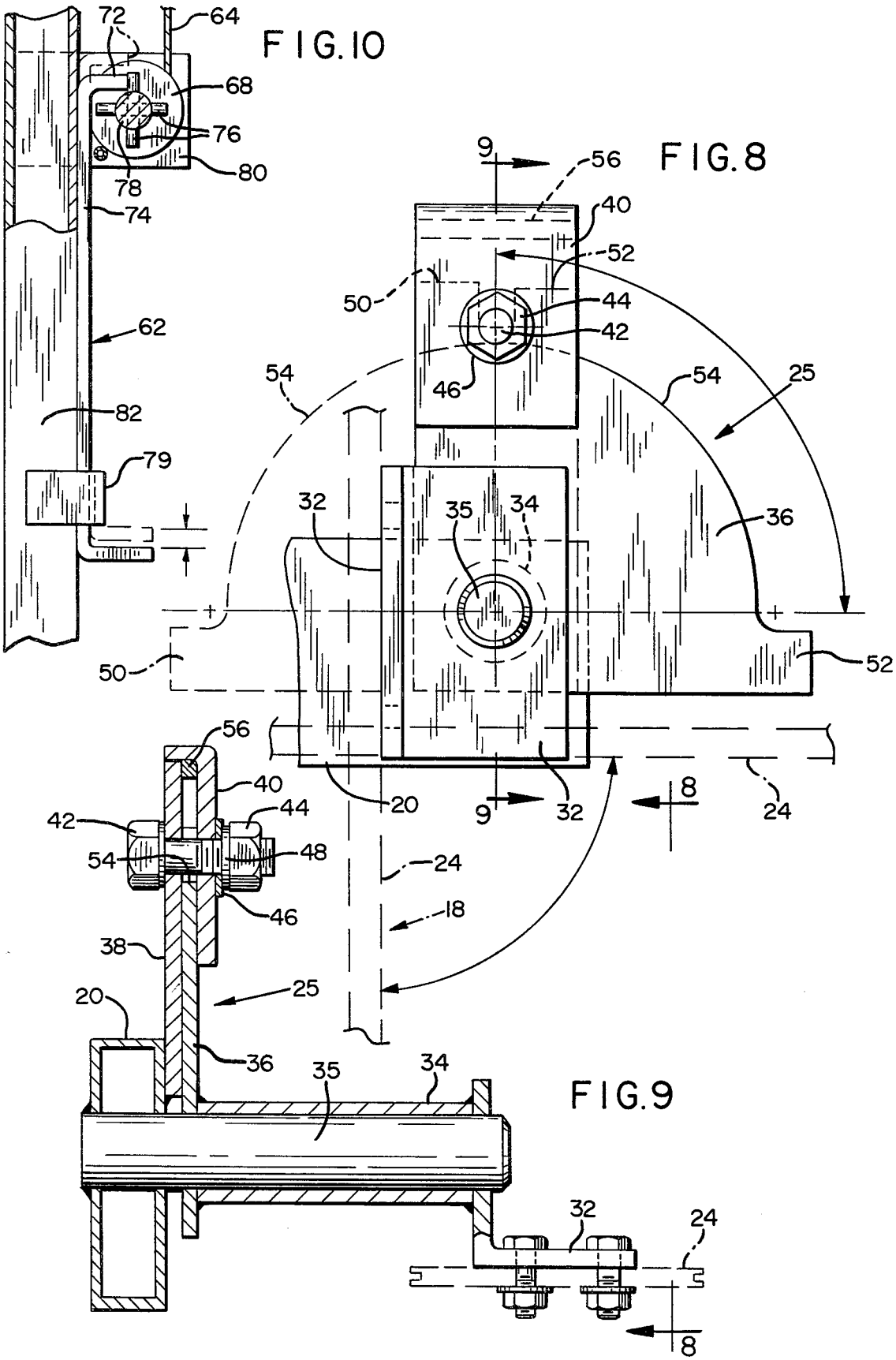
FIG. 8 is an enlarged elevation taken along line 8—8 of FIG. 1.
FIG. 9 is an enlarged vertical section taken along line 9—9 of FIG. 8.
FIG. 10 is an enlarged vertical section taken along line 10—10 of FIG. 3.

An L-shaped bracket 32 (FIGS. 1, 8 and 9) of the quadrant 25 is bolted to the inner end portion of the saw bar 24, and is welded to an offsetting tube 34 journaled on an axle 35 welded to the outer end of the crossarm 20. The tube 34 is welded to a quadrant plate 36 adapted to be clamped to a vertical latching plate 38 welded to the crossarm 20. This clamping is effected by an L-shaped clamp 40 and a bolt 42, a nut 44, a washer 46 and a lock washer 48, and the quadrant plate 36 can be clamped in any position between a vertical position in which the saw bar is in a vertical plane and a horizontal position in which the saw bar is in a horizontal plane extending outwardly beyond the end of the crossarm, these two extreme positions being thos usually used. Either a stop 50 or a stop 52 of the quadrant plate at the ends of an arcuate periphery 54 of the quadrant plate concentric with the tube 34 engages the bolt at the extreme positions of adjustment of the quadrant plate. A filler member 56 is secured to the upper portion of the clamp 40. The periphery 54 is just below the bolt 42.

The crossarm 20 is slidable in a horizontal guide 60 (FIGS. 1 and 3–6) secured rigidly to a vertical slide 62 slidable on the post 22 and adjustable vertically thereon by a cable 64 secured at its upper end to a hook 66 hooked into the top of the tubular post 22. The lower end of the cable is attached to a reel 68 rotatable by a manual crank 70 when a dog 72 (FIG. 10) of a latching bar 74 is raised above the path of pins 76 keyed to shaft 78 on which the reel is mounted. A guide 79 mounts the bar 74 slidably. The shaft 78 is journaled in plates 80 welded to opposite sides of vertical slide member 82 carrying the crossarm guide 60. A loop 84 is welded to the upper end of the member 82, and, at the lower end of the member 82, a clamping arm 86 is mounted pivotally by a pin 88 and a clevis 87 welded to the member 82. A rigid, horizontal, tubular member 89 of the guide 60 is welded to the member 82 and a locking cam 90 is mounted on an axle 92 carried by an angular bracket 94 welded to the member 89. An arm 96 welded to the cam enables the operator to move the cam between a release position and a clamping position in which the cam presses an angular end portion 98 of the arm 86 to force adjustment screws 100, 101 and 102 on the arm into clamping engagement with the post. Nuts 104 lock the adjustment screws in desired positions relative to the arm, the screws being threaded through tapped bores (not shown) in the arm 86.

The guide 60 includes guide loops 110 and 112 (FIG. 1) carrying adjustment screws 114 engaging the outer face of the crossarm 20. Adjustment screws 116 (FIG. 3) at supporting members 118, 120 and 122 also guide the crossarm. A clamping cam 124 carried by a shaft 126 on the member 120 is adapted to be manually moved by a crank arm 128 between a clamping position locking the crossarm against movement relative to the guide and a release position. When the cam 124 is in its release position, a pinion or sprocket 130 may be rotated by a crank arm 132 to move the crossarm 20 through a chain 134 fixed to the crossarm, a rack and pinion, in effect. One end of the chain is pinned to a clevis 136 (FIG. 4) welded to the crossarm, and the other end of the chain is clamped under tension to the crossarm by a bolt 138, a nut 140 and a washer 142, the chain extending through a hole 144 in the crossarm. By the above-described mechanism, the crossarm may be adjusted to and rigidly locked in any desired position of the chain saw 18 relative to the post 22.

Figure 2:
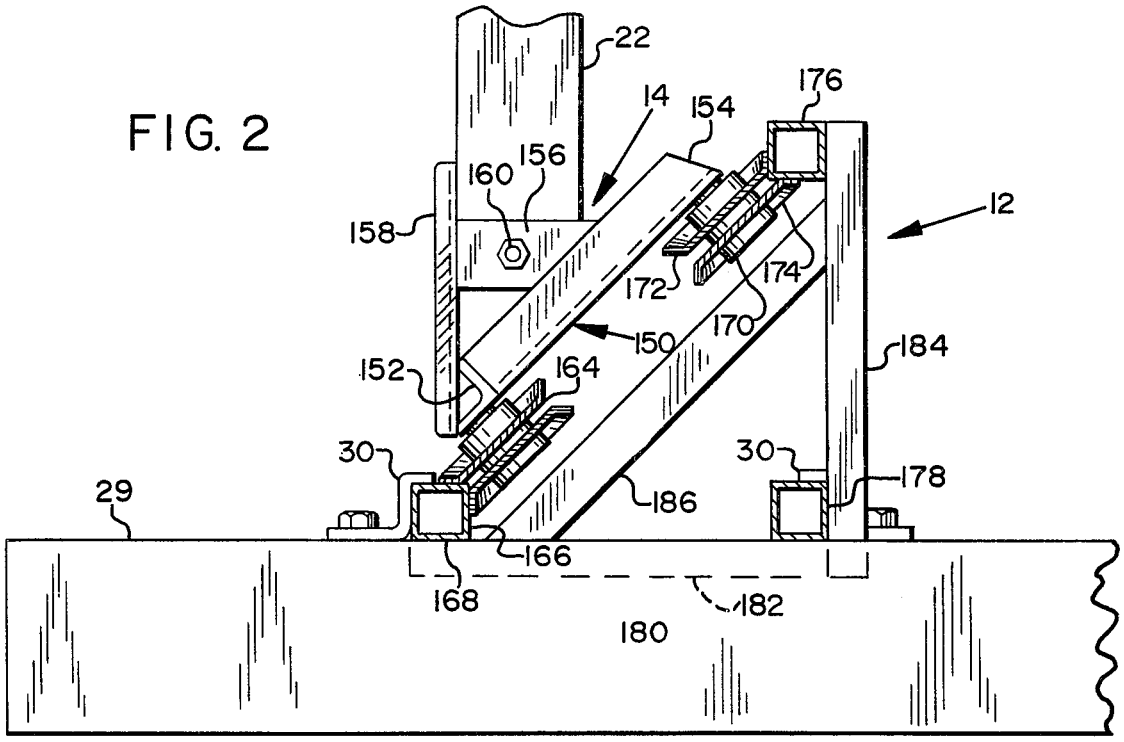
FIG. 2 is an enlarged vertical section taken along line 2—2 of FIG. 1.
Figure 4:
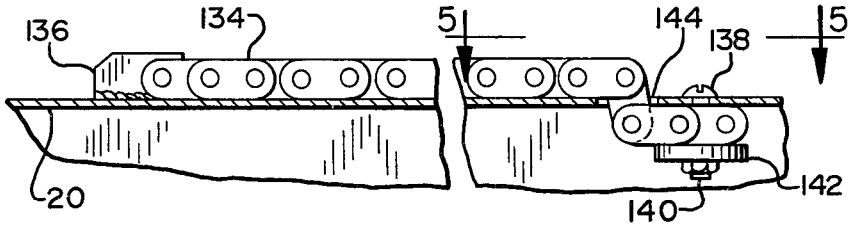
FIG. 4 is an enlarged horizontal section of a crossarm of the mill of FIG. 1.
Figure 5:
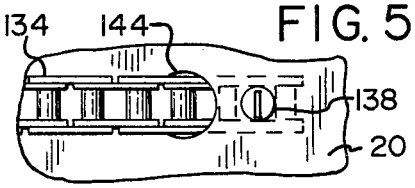
FIG. 5 is an enlarged elevation taken along line 5—5 of FIG. 4.
Figure 6:
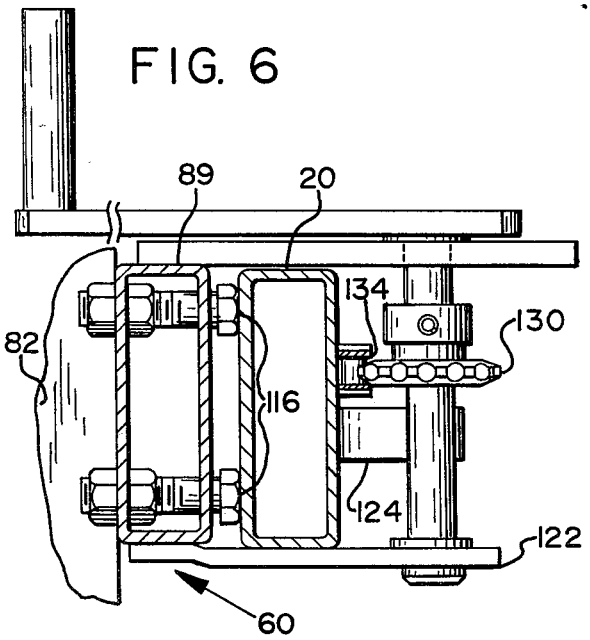
FIG. 6 is an enlarged vertical section taken along line 6—6 of FIG. 1.
Figure 7:
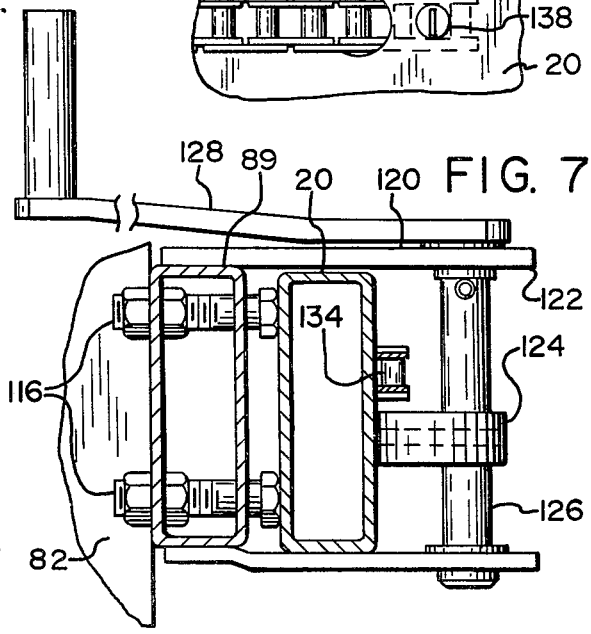
FIG. 7 is an enlarged vertical section taken along line 7—7 of FIG. 3.
Figure 3:
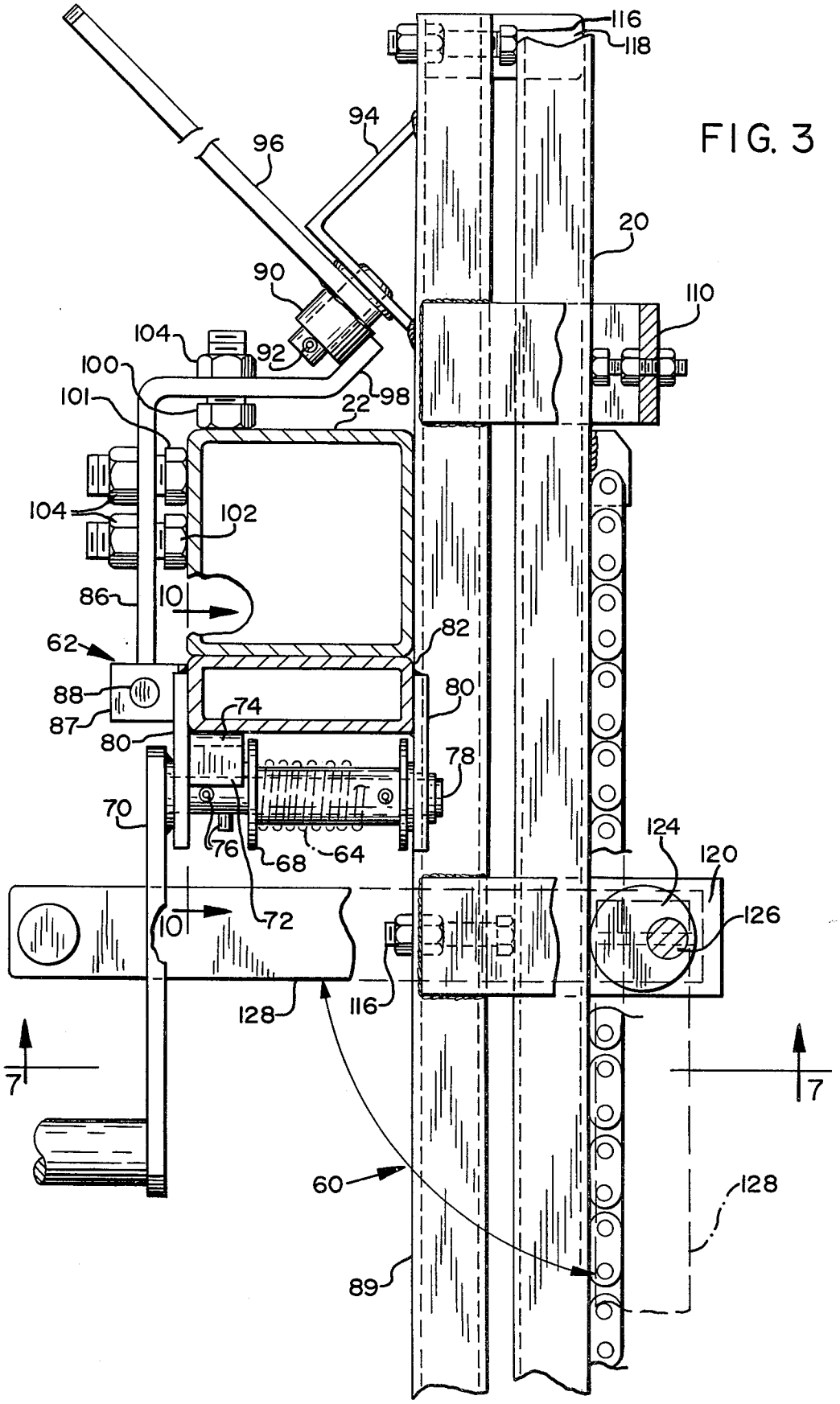
FIG. 3 is an enlarged horizontal section taken along line 3—3 of FIG. 1.

The carriage 14 (FIGS. 1 and 2) includes a base 150 including an angle member 152, a sloping channel member 154, a pair of spaced post mounting plates 156 welded to the channel member and to angular braces 158 welded together and to the angle member 152 to form a rigid triangle. A bolt 160 rigidly, but releasably, locks the post to the carriage. A pair of rollers 162 mounted on the end portions of the angle member 152 have flanged discs 164 and 166 engaging the top and inside faces of a lower square, tubular track 168. A roller 170 mounted on the channel member has flanged discs 172 and 174 engaging the inside and bottom faces of a square, tubular track 176. The rollers are deep grooved to provide sawdust clearance. A third, square, tubular member 178 parallels the tracks 168 and 176, all of which are secured rigidly to cross braces 180 comprising bottom members 182, upright members 184 and diagonal braces 186, the tracks 168 and 176 being secured rigidly to the members 182 and 184 and the member 178 being secured rigidly to both members 182 and 184. As best shown in FIG. 1, the tracks 168 and 176 and the member 178 are in sections and adjacent cross braces 180 at the ends are bolted together. Thus, the track may be dis-assembled for transportation; and the track may be lengthened by adding sections.

A somewhat sloping handle 190 (FIG. 1) having a handlebar 192 is connected at its lower end rigidly to the carriage along the track. The handle slopes out away from the track so that an operator is centered on the handlebar while able to walk along the outside of the track. A bowden wire 194 has its central, slack portion supported by a spring 196 secured to the upper end of the post 22. One end of the bowden wire is connected to the throttle of the chain saw and the other end to an arm 196 pivoted on the handlebar and movable by a handle 198 rigid on the arm 196.

I claim:

1. In a portable saw mill.

track means adapted to lie on the ground, log-holding means for holding a log in a position parallel to and to one side of the track means, carriage means manually movable along the track means, post means on the carriage means, a chain saw having a saw bar, and crossarm means adjustable on the post means and carrying the saw in a position offset from the post means for ripping a log held by the log-holding means.

2. The saw mill of claim 1 wherein the track means includes a plurality of rails and the track means and the log-holding means include a plurality of cross members supporting the log and the tracks.

3. The saw mill of claim 1 or 2 wherein the track means includes a plurality of sections each including a pair of track lengths and releasably secured together in positions in which the track lengths form a pair of tracks.

4. The saw mill of claim 1 wherein the track means includes a lower rail and upper rail and means supporting the rails in positions in which the lower rail is more remote from the log than the upper rail, the carriage means including a plurality of grooved rollers engaging the lower track and at least one upper roller engaging the upper track.

5. The saw mill of claim 4 wherein the rollers are flanged and have deep grooves.

6. The saw mill of claim 1 wherein the rails are tubular and rectangular in transverse cross-section.

7. The saw mill of claim 1 wherein the crossarm means includes a vertical slide adjustable on the post means, a horizontal guide carried by the vertical slide and a crossarm slidable in the horizontal guide.

8. The saw mill of claim 7 including rods-and-pinion means for adjusting the crossarm relative to the guide.

9. The saw mill of claim 8 wherein the rods-and-pinion means comprises a chain secured to the crossarm and a sprocket mounted rotatably on the guide.

10. The saw mill of claim 7 wherein the guide includes a plurality of adjustment screws and a cross member carrying the screws with their heads in engagement with the crossarm.

11. The saw mill of claim 7 including a cable secured at one end to the upper end portion of the post means, and winch means mounted on the slide and to which the cable is secured.

12. The saw mill of claim 7 wherein the vertical slide includes an L-shaped slidable member engaging two sides of the post means, L-shaped arm means pivoted on the slidable member, and cam means for pressing the arm means against the post means.

13. The saw mill of claim 12 including a plurality of adjustment screws secured to the arm means with the heads of the screws engaging the post means.

14. The saw mill of claim 1 including a handle secured to the carriage means and extending rearwardly and upwardly therefrom and to a position offset to one side of the track means.

* * * * *